United States Patent [19]

Vincent et al.

[11] Patent Number: 5,065,169

[45] Date of Patent: Nov. 12, 1991

[54] DEVICE TO ASSURE PAPER FLATNESS AND PEN-TO-PAPER SPACING DURING PRINTING

[75] Inventors: Kent D. Vincent, Cupertino; John P. Ertel, Portola Valley, both of Calif.

[73] Assignee: Hewlett-Packard Company, Palo Alto, Calif.

[21] Appl. No.: 412,582

[22] Filed: Sep. 25, 1989

Related U.S. Application Data

[63] Continuation of Ser. No. 170,507, Mar. 21, 1988, abandoned.

[51] Int. Cl.[5] ..... B41J 2/01

[52] U.S. Cl. ..... 346/140 R; 346/139 C; 400/56

[58] Field of Search ..... 436/140, 136, 139 C; 400/56, 59

[56] References Cited

U.S. PATENT DOCUMENTS

| | | | |
|---|---|---|---|
| 4,010,834 | 3/1977 | Linder | 400/56 |
| 4,121,224 | 10/1978 | Takeuchi | 346/139 C |
| 4,254,424 | 3/1981 | Landheer | 346/139 C |
| 4,364,067 | 12/1982 | Koto | 346/140 |
| 4,390,292 | 6/1983 | Krenz | 400/59 |
| 4,412,232 | 10/1983 | Weber | 346/140 |
| 4,503,443 | 3/1985 | Dagna | 346/140 |
| 4,593,296 | 6/1986 | Dagna | 346/140 |
| 4,630,077 | 12/1986 | Berruti | 346/140 |
| 4,682,188 | 7/1987 | Castellano | 346/140 |
| 4,727,805 | 3/1988 | Pichler et al. | 400/59 X |
| 4,755,836 | 7/1988 | Ta | 346/140 |
| 4,843,338 | 6/1989 | Rasmussen | 346/140 |

FOREIGN PATENT DOCUMENTS

| | | |
|---|---|---|
| 2902037 | 7/1980 | Fed. Rep. of Germany . |
| 2158841 | 6/1973 | France . |
| 30228 | 3/1978 | Japan . |
| 206658 | 10/1985 | Japan . |

OTHER PUBLICATIONS

Shinshiyuu Seiki, Kiichi Kawamura, Ink Jet Recorder, Aug. 5, 1982, vol. 6, No. 146 (M-147) (1024) Abstracts of Japan.

Toshiaki Miyauchi, Printer, Sep. 4, 1987, vol. 11, No. 272 (M -622) (2719) Abstracts of Japan.

Riyuuji Kiura, Head Mechanism For Thermal Transfer Printer, Jan. 28, 1986 vol. 10, No. 21 (M-449) (2078) Abstracts of Japan.

D. K. Rex, Printhead Spacing Adjustment For Paper Thickness, Aug. 1983, vol. 26, No. 3B pp. 1476-1477, IBM Technical Disclosure Bulletin.

*Primary Examiner*—Joseph W. Hartary

[57] ABSTRACT

A printer includes an inkjet pen to eject ink drops for printing on the surface of a sheet, a carriage mounted to carry the pen back and forth on the sheet, and a skid-like spacer to ride upon the printed surface. The spacer maintains a preselected spacing between the pen and the printed surface and, also, maintains paper flatness at the localized area of printing.

11 Claims, 2 Drawing Sheets

DEVICE TO ASSURE PAPER FLATNESS AND PEN-TO-PAPER SPACING DURING PRINTING

CROSS REFERENCE TO RELATED APPLICATION

This application is a continuation of application Ser. No. 07/170,507, filed 3/21/88, now abandoned.

TECHNICAL FIELD

The present invention generally relates to printers and, more particularly, to improved paper holddown devices for printers.

BACKGROUND ART

In printers such as inkjet printers having traveling inking means (e.g., inkjet pens), ink drops follow trajectories determined by the vector sum of the ink ejection velocity (Ve) and the velocity of the inking means (Vp). For example, in an inkjet printer providing resolution of about 300 dots per inch, a typical pen velocity would be about 0.34 m/sec and a typical inkjet ejection velocity would be about 5 m/s. If distance Dp is defined as the distance measured laterally along the surface of a printed sheet between the inking means and the intended location of ink dot placement on a sheet at the time of inkdrop ejection, and if distance Ds is defined as the pen-to-sheet spacing as measured perpendicular to the sheet surface, then the ratio of Dp to Ds is proportional to the ratio of the velocity Vp to the velocity Ve. Thus, assuming that the controllable variables Vp and Ve are fixed for a particular inkjet printer, the lateral distance Dp can be calculated to equal the quantity $$\left(\frac{Vp}{Ve}\right)Ds.$$

Ideally, distance Dp remains constant whenever a sheet is being printed to avoid misalignment of printed characters; however, because pen-to-sheet distance Dp is a function of distance Ds, the latter distance must also remain constant to maintain accurate ink drop placement during printing.

The maintenance of constant pen-to-sheet spacing distance, Ds, is especially critical in inkjet printers of the bidirectional type. In such devices, an inkjet pen prints a swath of ink drops while moving both from right-to-left and from left-to-right across the surface of a sheet. Normally, between each change in printing direction in bidirectional inkjet printers, the printed sheet is indexed a swath width (e.g., about ⅜ inch). Because such printers provide ink dots in columns in each swath, print defects will appear unless dot columns on adjacent swaths are closely aligned. In fact, it has been calculated that print defects will be perceived unless dot columns on adjacent swaths are aligned to within 1/10 of a dot diameter, or about 0.00033 inch at a resolution of about three hundred dots per inch. At the velocities described in this example, such alignment of dot columns in successive swaths requires that the pen-to-sheet spacing distance Ds be held to tolerances of about ±0.0025 inch.

Because of the precise tolerances required, conventional inkjet printers are often unable to provide consistently acceptable print quality. In fact, in conventional inkjet printers, the additive effect of manufacturing tolerances often cause pen-to-sheet spacing distance Ds to vary substantially more than desired. Also, the spacing distance Ds in conventional inkjet printers can be affected by lack of flatness in carriage guides and paper support plates.

Further, ink dot placement during printing can vary because of variations in sheet thickness and because of curls and cockles in sheets. For example, sheet thicknesses commonly used in printers vary by about 0.002 to about 0.007 inches. Also, cockles can be present because of paper defects and because of moisture present during printing.

To reduce the effects of paper curl and cockle on dot placement during printing, conventional practice is to employ sheet holddown devices such as electrostatic or suction devices. In an electrostatic holddown device, for example, paper flatness is maintained by establishing electrostatic attraction between a flat support plate on the printer and the back surface of a sheet to be printed. Likewise, in vacuum holddown devices, sheet flatness is maintained by providing suction between a support plate and the back surface of a sheet to be printed. It should be noted that, in either type of holddown device, direct contact of the holddown device with the printed surface is avoided to minimize ink smearing and other adverse affects on print appearance.

Although conventional holddown devices are fairly effective in maintaining sheet flatness during printing, they have drawbacks. One drawback is that such devices do not compensate for variations in sheet thickness. Another drawback is that the maximum holddown force on a sheet is limited because of the necessity to maintain low frictional loads on transport devices which index the sheets. In conventional inkjet printers, such limitations can cause pen-to-sheet spacing distances to vary from swath to swath. Also, the holddown pressure at a localized area being printed may be insufficient to flatten cockles and other paper irregularities; that is, the pressure required to flatten cockles in a sheet may be too great to allow precise paper indexing, especially in vacuum devices which exert pressure over the entire surface area of a sheet. Finally, conventional holddown devices are complicated and relatively expensive.

SUMMARY, OBJECTS AND ADVANTAGES OF THE INVENTION

An object of the present invention is to provide improved paper holddown devices for use with printers.

More particularly, an object of the present invention is to improve printers, especially inkjet printers of the bidirectional printing type, by providing a device to accurately maintain pen-to-sheet spacing and sheet flatness during printing and, thereby, to minimize spacing deviations that cause misalignment in printed characters.

In accordance with the foregoing objects, the present invention generally provides a printer comprising an inking device that ejects ink drops for printing the surface of a sheet, and a spacer interposed between the inking means and the sheet surface to ride upon the surface being printed so as to maintain preselected spacing. In one particular embodiment, the spacer is a generally L-shaped member whose leg is connected to the inking device and whose foot is positioned to extend parallel to the sheet surface to ride as a skid on the printed surface of the sheet. In general, however, the spacer can be a skid, a wheel, a roller, or any other bearing-like device suited for supporting an inking device directly on a sheet with a preselected pen-to-sheet spacing.

The device of the present invention provides substantial advantages over conventional holddown mechanisms in printers because it directly acts on the printed surface to assure paper flatness and spacing accuracy. In contrast to conventional electrostatic and suction-type holddown mechanisms, devices according to the present invention maintain constant pen-to-sheet spacing even when paper thickness varies or when there are printer mechanism problems such as lack of flatness or straightness in carriage guide rods and paper support plates. Still further, the present invention simplifies printer design while increasing allowable manufacturing tolerances, thereby substantially reducing costs.

Additional objects and advantages can be ascertained by reference to the following description and attached drawings which illustrate various embodiments of the invention. Identical components are identified by the same reference numerals in the various figures.

DETAILED DISCLOSURE OF BEST MODE OF CARRYING OUT THE INVENTION

Figure 1:
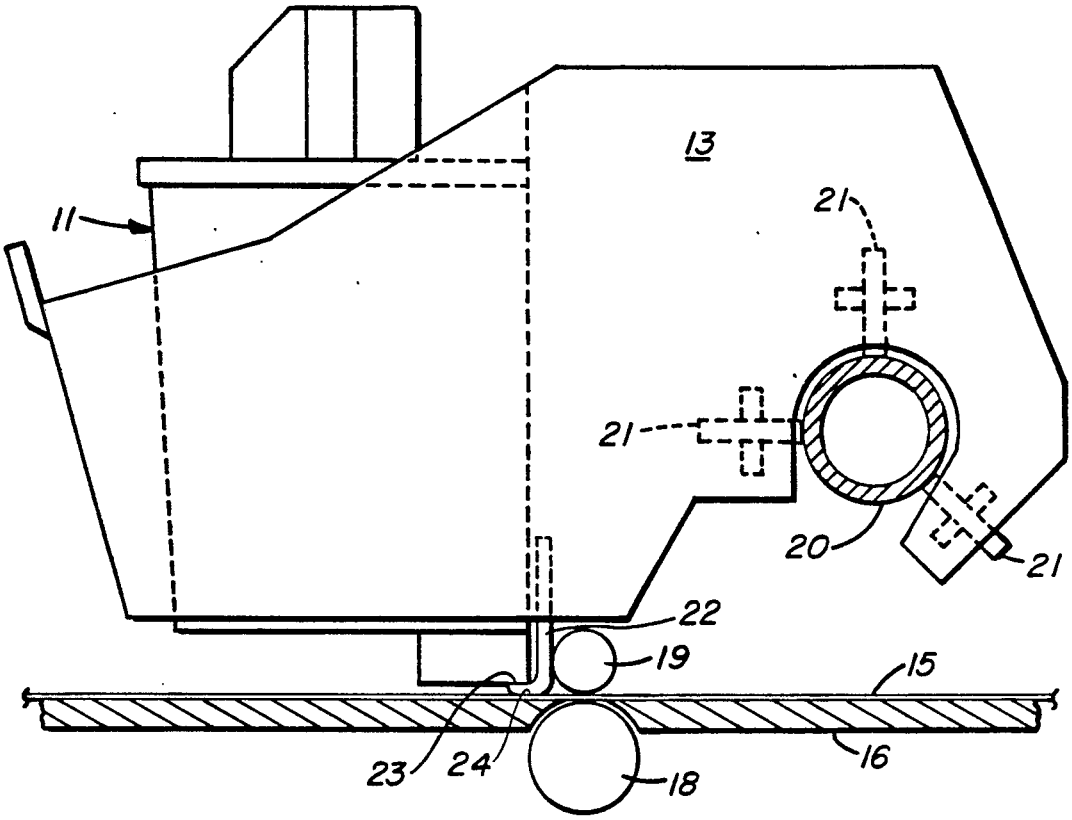
FIG. 1 is a side view of a device according to the present invention.

In the preferred embodiment, a paper holddown device according to the present invention is used in conjunction with a printer of the inkjet type. Accordingly, FIG. 1 shows a bidirectional inkjet printer includes an inkjet pen 11 that is held rigidly in a movable carriage 13 so that the pen nozzle 14 is above the surface of a sheet 15 which lays substantially flat on a stationary support plate 16. Further, the illustrated inkjet printer includes a drive roller 18 and a pinch roller 19 which are controlled to periodically index the sheet across the surface of plate 16. It should be understood that various systems for controlling sheet indexing are well known.

As also shown in FIG. 1, carriage 13 is slidably journaled to a linear guide rod 20 by bearings 20A. Guide rod 20 is fixed to the printer chassis, not shown, to extend in the cross-direction parallel to the surface of sheet 15. (As used herein, the term "cross direction" refers to a direction perpendicular to the paper indexing direction.) Guide rod 20 and bearings 20A are designed to allow carriage 13 to move from side-to-side across the surface of a printed sheet but, in contrast to conventional inkjet printers, rotation of carriage 13 about rod 20 is not substantially restricted by the design of the rod or its bearings.

Figure 1A:
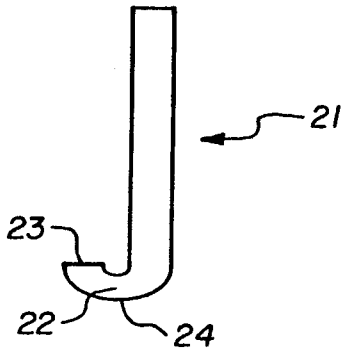
FIG. 1A is a side view of one component of the device of FIG. 1, enlarged for purposes of clarity.

As further shown in FIG. 1 and to an enlarged scale in FIG. 1A, an L-shaped spacer member, generally designated by the number 21, is attached to carriage 13 with its foot 22 interposed between carriage 13 and sheet 15. Preferably, the upper surface 23 of spacer 21 abuts the lower end of inkjet pen 11 adjacent nozzle 14 and, thus, provides a physical stop. Also in the preferred embodiment, spacer 21 extends substantially and primarily across the width of inkjet pen 11 and its lower surface 24 is generally planar to provide a broad face to ride upon sheet 15. Thus, it can be understood that the distance Ds between stop surface 23 and riding surface 24 defines the desired spacing of inkjet nozzle 14 from the surface of sheet 15.

In practice, it is necessary that spacer 21 have low contact friction with the surface of sheet 15 in both the cross-direction and in the indexing direction. Low contact friction in the cross-direction is required to facilitate back and forth travel of the inkjet pen, while low contact friction in the indexing direction is required to facilitate operation of the sheet transport device. To reduce contact friction, the peripheral edges of riding surface 24 are arcuate. Also, contact friction is reduced by the selection of the materials and the surface finish of riding surface 24. For example, riding surface 24 can be polished chromeplate to minimize friction as well as to increase wear life. To further reduce contact friction, a device (not shown) can be provided to lift spacer 21 off the sheet during indexing; normally, such a lifting device is operative at the margins of the sheet.

Another measure which can be taken to reduce contact friction is to provide an air bearing at the riding 24 surface of spacer 21. Such an air bearing is readily implemented by providing a source of pressurized gas and by forming appropriate holes or channels within riding surface 24 to allow the pressurized gas to escape between the riding surface and the face of sheet 15. In this embodiment, the spacer can still be said to ride on the sheet surface, albeit via a cushion of pressurized gas.

Figure 2:
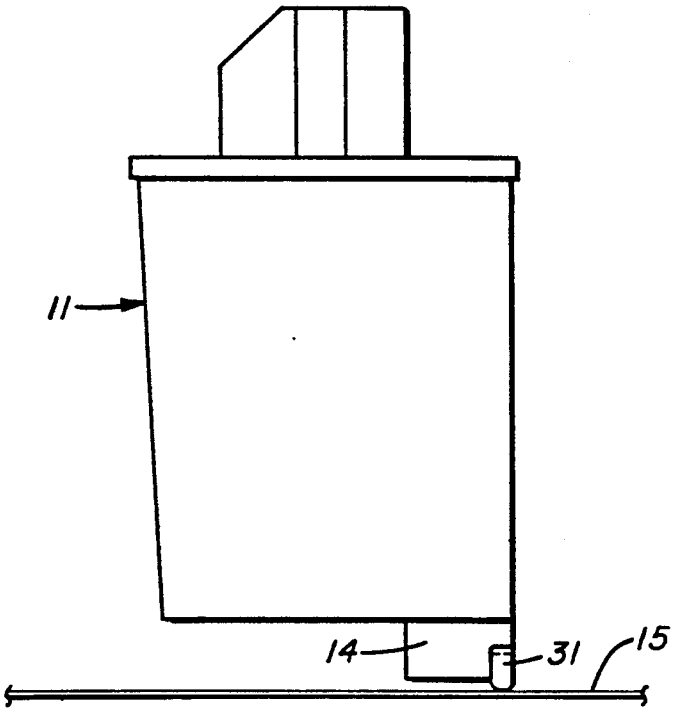
FIG. 2 is a sideview of an alternative embodiment of the present invention.
Figure 3:
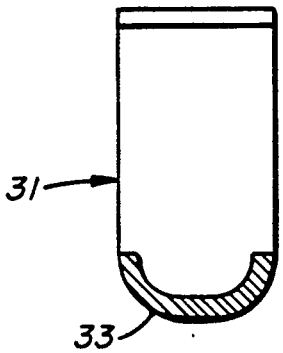
FIG. 3 is a cross-sectional detail, drawn to an enlarged scale for purposes of clarity, of a portion of the assembly in FIG. 2 in an inverted position.
Figure 4:
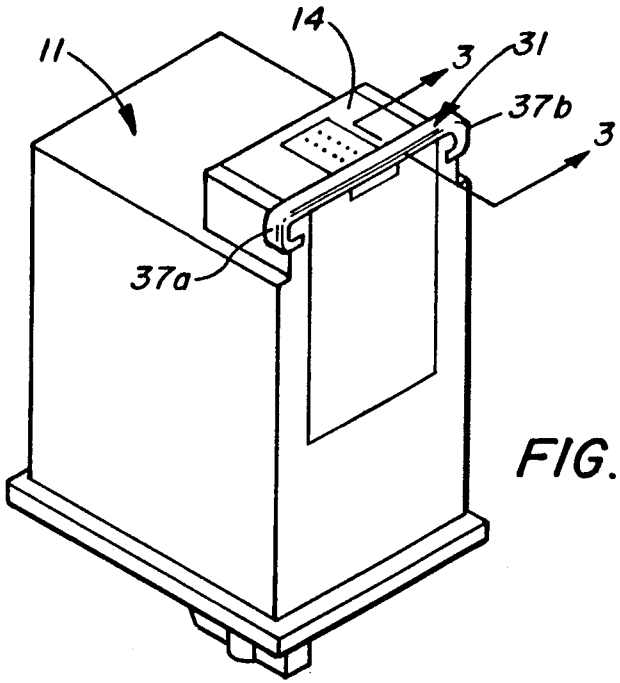
FIG. 4 is a perspective view of the assembly of FIG. 2.

FIGS. 2 through 4 show an alternative embodiment of the present invention in which a spacer 31 is attached to the body of inkjet pen 11 rather than to carriage 13. More particularly, spacer 31 is an elongated rail-like member that is mounted to extend parallel to the longitudinal axis of guide shaft 20 across the body of inkjet pen 11. As shown in cross-section in FIG. 3, spacer 31 has a generally planar riding surface 33 with arcuate peripheral edges to accommodate movement in the indexing direction. Also, as shown in perspective in FIG. 4, the spacer ends **37*a* and 37*b*** are arcuate to accommodate movement in the cross-direction.

Figure 5:
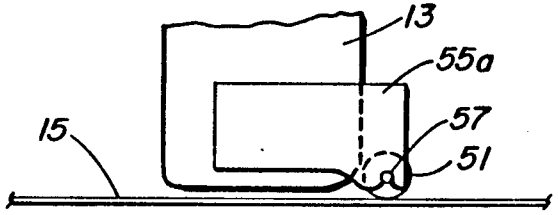
FIG. 5 is a sideview of yet another alternative embodiment of the present invention.
Figure 6:
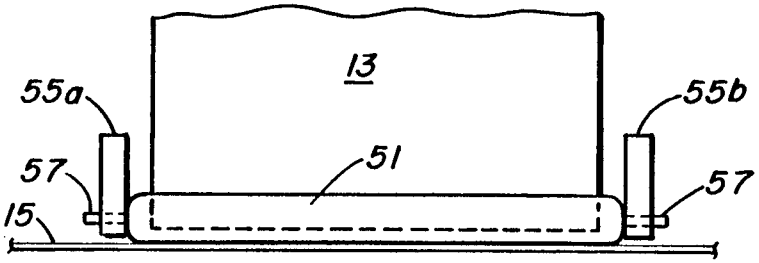
FIG. 6 is a fragmentary endview of the device of FIG. 5.

FIGS. 5 and 6 show yet another alternative embodiment of the present invention.. In this embodiment, a roller-like spacer 51 is connected to carriage 13 by flanges **55*a* and 55*b*. The flanges accept an axle 57 which extends coaxially of the roller-like spacer to allow it to roll freely in the indexing direction. As shown in FIG. 6, the ends of roller-like spacer 51 are arcuately curved so that it easily skids back and forth over the surface sheet 15** in the cross-direction.

OPERATION

In operation of the inkjet printer of FIG. 1, sheet 15 is held stationary by drive roller 18 while carriage 13 carries inkjet pen 11 back and forth across the sheet to print swaths of ink dots. After each swath is printed, roller 18 is driven so that sheet 15 is advanced in the direction indicated by the arrow over a distance equal to the swath width, and then carriage 13 again carries inkjet pen 11 across the sheet to print a second swath.

This back-and-forth movement of carriage 13 is continued until the sheet is printed as desired.

As a sheet 15 is being printed, spacer 21 of FIG. 1 slides across the printed surface of the sheet. Because of its proximity to the printed area, spacer 21 flattens the sheet at the localized area of printing. The force exerted by spacer 21 to flatten sheet 15 can be referred to as the contact force. The contact force is primarily determined by the weight distribution of inkjet pen 11 and carriage 13 relative to guide rod 20. That is, guide rod 20 acts as a fulcrum about which carriage 13 is pivoted. The net force, or torque, acting about rod 20 in the counterclockwise direction in FIG. 1 depends upon the counterbalancing weight of the carriage on the opposite side of the rod. In practice, carriage 13 is mounted and balanced such that the contact force in the counterclockwise direction is sufficient to maintain the riding surface of spacer 21 in contact with the surface of sheet 15 and to assure substantial paper flatness under inkjet nozzle 14 without causing undue frictional drag.

At this juncture, it can be noted that the localized contact force exerted by spacer 21 can exceed the localized force exerted by a conventional holddown device which operates upon the entire paper surface. Accordingly, spacer 21 can provide a flatter surface at the point of printing than conventional holddown devices. In practice, spacer 21 holds pen-to-sheet spacing constant within one to two thousands of an inch.

Operation of the spacers in FIGS. 2 through 6 is substantially the same as the operation of spacer 21 in FIG. 1. That is, those spacers either slide or roll over the printed surface while concentrating the contact force over localized areas near the point of ink impact with sheet 15. Thus, it can be appreciated that the spacers can take various forms, including notatable ball-like shapes (not shown), as long as they are capable of supporting an inking device directly on the surface of sheet 15 at the desired spacing.

Although the present invention has been described in its preferred embodiment, those skilled in the art will appreciate that variations may be made without departing from the spirit and scope of the invention as defined in the appended claims. In addition to the variations already mentioned, it should be noted that spacers can be formed integral with carriage 13 or pen body 11. In still another variation, a spacer is not physically attached to either carriage 13 or pen 11 but, instead, is mounted to float between the carriage and the surface of sheet 15. Also, although the preceding discussion has emphasized inkjet pens that move back-and-forth in the cross-direction, the afore-described spacing devices could be used with printers having stationary inkjet pens or with so-called wire-matrix print heads as well as other inking means, such as so-called daisy wheel printers. Still further, although the spacing devices have been discussed in the context of operating upon a flat surface, they could operate upon a generatrix of a cylindrical surface.

What is claimed is:

1. An inkjet printer comprising:

inking means including inkjet pen means having a plurality of inkjet nozzles for printing on the surface of a sheet as the inkjet pen means is driven to traverse the surface of the sheet; and single spacer means interposed between the inking means and the sheet so that the spacer means rides directly upon the printer surface of the sheet to always maintain preselected minimum spacing between the inking means and the sheet during printing while, simultaneously, exerting force to provide a sheet flattening action at the localized area of printing;

said spacer means having surface area disposed parallel to the sheet surface to ride directly thereon immediately before printing the localized areas and projecting in both the direction of travel of the inkjet pen means and perpendicular to the direction of travel to flatten cockles in the sheet in the localized areas adjacent the nozzles of the inkjet pen means, the extent of the projection in the direction of travel being substantially greater than the extent of projection in the perpendicular direction.

2. A printer according to claim 1 wherein the spacer means is a generally L-shaped member whose leg is connected to the inking means and whose foot is positioned to extend parallel to the sheet surface for providing the sheet flattening action, with the upper surface of said foot being located to abut the inking means and the lower surface of the foot being disposed to ride as a skid on the printed surface of the sheet, said foot being dimensioned to extendsubstantially across the width of the inking means parallel to the sheet surface.

3. A printer according to claim 2 wherein the surface of the spacer means which rides upon the sheet is substantially planar with arcuate peripheral edges.

4. A printer according to claim 1 wherein the spacer means is an elongated rail-like member which is generally U-shaped in transverse cross-section and which is connected to the inking means to extend substantially across its width in the cross-direction to ride as a skid on the surface of the sheet to be printed.

5. A printer according to claim 1 wherein the spacer means comprises an elongated roller-like member which is rotatably connected to the carriage means to extend across its width in the cross-direction.

6. A printer according to claim 1 wherein the spacer means has a rotatable arcuate surface to ride upon the surface of the sheet to be printed.

7. An inkjet printer comprising:

inkjet pen means having nozzles for printing on the surface of a sheet;

carriage means mounted to carry the inkjet pen means to traverse back and forth across the sheet;

indexing means to index the sheet on a surface adjacent the inkjet pen means; and single spacer means interposed between the inkjet means and the sheet and which directly rides upon the surface of the sheet to be printed to, simultaneously, both maintain a preselected minimum spacing between the inkjet pen means and the sheet surface at all times during printing and to exert force to enhance sheet flatness over a relatively substantial area adjacent the inking means immediately before the area is printed;

said spacer means projecting in both the direction that the inkjet pen means and perpendicular to the direction of travel to traverse the sheet so that cockles in the sheet are flattened in the localized areas adjacent the nozzles of the inkjet pen means, the extent of the projection in the direction of travel being substantially greater than the extent of projection in the perpendicular direction.

8. An inkjet printer comprising:

a support member to position a sheet for printing;

indexing means to index the sheet across the support member;

guide means fixedly mounted to extend across the sheet perpendicular to the indexing direction and parallel to the sheet surface;

carriage means pivotally mounted to the guide means to travel back and forth across the sheet;

inkjet pen means carried by the carriage means to traverse back and forth across the sheet surface with the carriage means while ejecting ink drops to print the sheet surface; and single spacer means mounted to travel with the carriage means and having a substantial planar surface adapted to ride directly upon the printed surface of the sheet to exert a localized sheet flattening force before the area is printed while, simultaneously, maintaining a preselected minimum spacing between the printed surface and the inkjet pen means at all times;

said spacer means projecting in both the direction of travel of the inkjet pen means and perpendicular to the direction of travel in traversing the sheet so that cockles in the sheet are flattened in the localized areas adjacent the nozzles of the inkjet pen means, the extent of the projection in the direction of travel being substantially greater than the extent of projection in the perpendicular direction.

9. An inkjet printer according to claim 8 wherein spacer means is a generally L-shaped member whose foot is positioned such that the inkjet pen means abuts the upper surface of the foot and the lower surface of the foot rides as a skid on the printed surface of the sheet.

10. An inkjet printer according to claim 8 wherein the spacer means is an elongated rail-like member which is connected to move with the carriage means and to extend generally substantially across the width of the pen means in the cross-direction.

11. An inkjet printer according to claim 8 wherein the skid means comprises an elongated roller which is rotatably affixed to extend substantially across the width of the inkjet pen means.

* * * * *